United States Patent [19]

Jimenez

[11] 4,037,801

[45] July 26, 1977

[54] GRINDING APPARATUS

[75] Inventor: James A. Jimenez, Temple City, Calif.

[73] Assignee: Electra Food Machinery, Inc., El Monte, Calif.

[21] Appl. No.: 662,457

[22] Filed: Mar. 1, 1976

[51] Int. Cl.[2] ..... B02C 7/14; B02C 7/16

[52] U.S. Cl. ..... 241/247; 198/608; 198/662; 241/259.1

[58] Field of Search ..... 241/245, 247, 248, 259.1; 198/64, 214, 608, 657, 662

[56] References Cited

U.S. PATENT DOCUMENTS

| | | | |
|---|---|---|---|
| 417,760 | 12/1889 | Waldron et al. | 241/248 |
| 643,637 | 2/1900 | Ensberg | 241/247 X |
| 932,882 | 8/1909 | Moore et al. | 241/245 UX |
| 2,064,666 | 12/1936 | Krushel | 241/248 X |
| 2,279,640 | 4/1942 | Ringmarck | 198/214 X |
| 3,845,909 | 11/1974 | Johansson | 241/247 X |
| 3,847,363 | 11/1974 | Reinhall | 241/245 |
| 3,934,829 | 1/1976 | Coucher | 241/259.1 |

*Primary Examiner*—Roy Lake
*Assistant Examiner*—Howard N. Goldberg
*Attorney, Agent, or Firm*—James E. Brunton

[57] ABSTRACT

An apparatus for grinding hard grains and similar materials having a unique force feed arrangement which insures uniform material feed to the grinding members and a resulting uniform output of ground material from the apparatus.

4 Claims, 5 Drawing Figures

GRINDING APPARATUS

BACKGROUND OF THE INVENTION

1. Field of the Invention

The present invention relates generally to an apparatus for grinding corn or other materials. More particularly, the invention relates to a novel continuous grinding apparatus wherein the material to be ground is continuously force fed at a uniform, controllable rate to the grinding elements of the apparatus.

2. Discussion of the Prior Art

Various types of apparatus for grinding hard grains such as corn and wheat have been suggested in the past. Typically, such machines embody two relatively movable annular shaped grinding members between the flat faces of which the material to be ground is fed by means of a continuously rotating axially extending feed worm or auger. Generally, the material to be ground is placed in a dispensing hopper and then, by force of gravity, is dispensed onto the feed worm for subsequent introduction between the faces of grinding members. After being ground, the material falls by force of gravity from between the grinding memebers into a suitable receptacle. Representative of this type of apparatus is that described in U.S. Pat. No. 1,244,352 issued to L. F. McNally.

One of the principal drawbacks of gravity fed grinding apparatus of the aforementioned character is the non-uniformity of input of material to the grinding members as the dispensing hopper empties and the resulting non-uniformity of output from the apparatus. This drawback is particularly troublesome when the grinding apparatus forms an operating link in a continuously operating food processing line. For example, if the grinding apparatus is feeding the ground material to another piece of apparatus in the processing line, such as a mixer, a non-uniform input of material at the mixing station can cause improper mixing of ingredients and an unacceptable end product. This deficiency has been completely eliminated by the novel apparatus of the present invention wherein the material to be ground is force fed at a precisely controllable rate to the grinding members.

As will become apparent from the discussion which follows, the unique design of the apparatus of the present invention insures a precisely controllable rate of input of raw material to the grinding heads and in this way insures a uniform rate of output of ground material from the apparatus.

Applicant is aware of the following prior art patents which represent the closest art known to applicant and serve to illustrate the novelty of the apparatus of the present invention:

Johnson, et al. — U.S. Pat. No. 3,384,138; Johnston — U.S. Pat. No. 2,178,636; Orrell — U.S. Pat. No. 2,479,080; Woodcock — U.S. Pat. No. 976,535.

SUMMARY OF THE INVENTION

It is an object of the present invention to provide a novel material grinding apparatus for grinding hard grains such as corn and the like which has a uniform and controllable rate of output of ground material. The uniform material output feature of the apparatus permits it to be used as an integral part of a continuous automatic food processing line and enables it to be operatively coupled to other equipment such as, for example, mixers which require a constant and predictable input of the ground material.

It is another object of this invention to provide an apparatus of the aforementioned character in which the material to be ground can be gravity fed from a material dispensing hopper of relatively large capacity directly to a force feeding subassembly which is operatively coupled with a feed worm adapted to feed the material to be ground to the grinding members of the apparatus.

It is still another object of the invention to provide an apparatus as described in the preceding paragraph in which the novel force feeding subassembly of the apparatus is so constructed as to receive the material to be ground from the hopper and supply it to the feed worm at a constant rate.

It is still another object of the invention to provide an apparatus of the class described which is of rugged design, is highly reliable in operation, and can be inexpensively manufactured and maintained.

In summary, these and other objects of the invention are achieved by a material grinding apparatus having a material grinding chamber having an opening for receiving material to be ground; first and second cooperating material grinding members in the chamber, one of the members being rotatable relative to the other; a first feed worm disposed in axial alignment with the opening in the grinding chamber for feeding the material to be ground to the grinding members; and a force feed mechanism cooperatively associated with the first feed worm for controllably feeding the material to be ground to the first feed worm at a predetermined rate, the force feed means comprising a material dispensing hopper and a second feed worm disposed in axial alignment with the first feed worm and cooperatively associated therewith for receiving the material from the hopper and feeding it to the first feed worm.

DESCRIPTION OF THE PREFERRED EMBODIMENT

Figure 1:
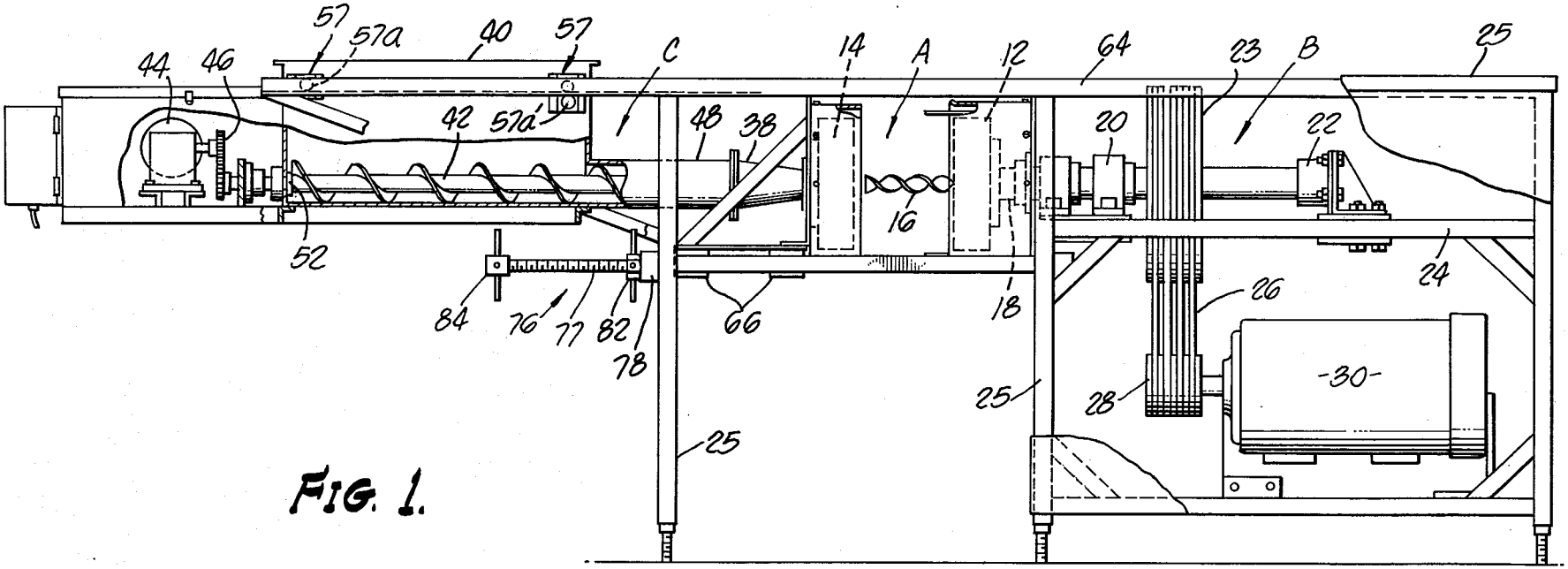
FIG. 1 is a side elevational view of the apparatus of the invention partly broken away to show internal construction.

Turning now to the drawings and particularly to FIG. 1, the apparatus of the invention includes the following major operating components: A material grinding chamber generally designated as "A" which houses first and second cooperating material grinding members 12 and 14 respectively; a first helically configured feed worm 16 for feeding the material to be ground between the opposing faces of the grinding members; a driving means "B" for rotatably driving the first grinding member and the first feed worm; and a force feed means generally designated as "C" for controllably feeding the material to be ground to the first feed worm 16 at a predetermined rate.

Figure 2:
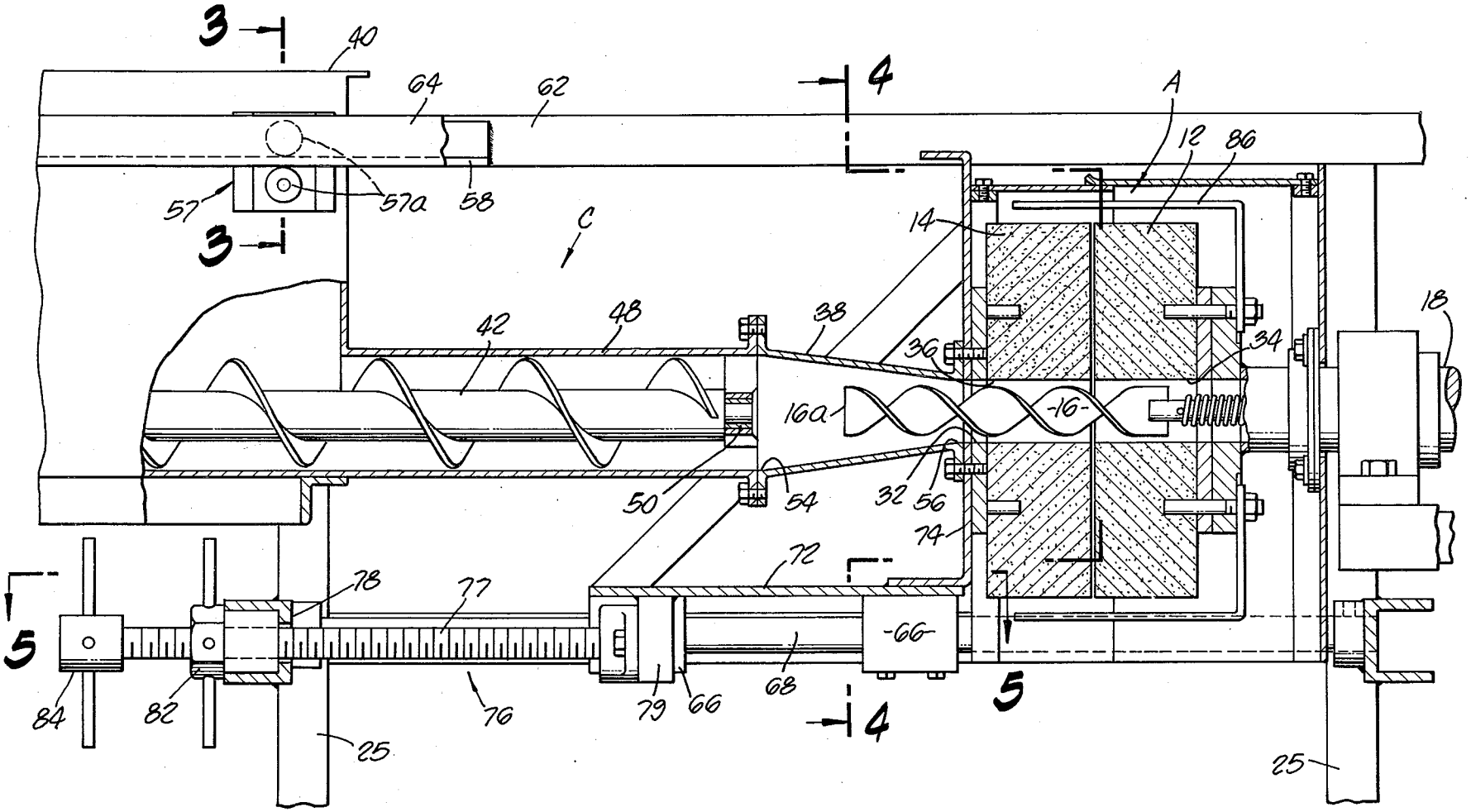
FIG. 2 is an enlarged side elevational view of the forward part of the apparatus of FIG. 1 shown partly in cross-section and illustrating the interrelationship among the force feed means, the first feed worm, and the material grinding members of the apparatus.

Referring as well to FIG. 2, the grinding members 12 and 14 can be seen to be of a type well known in the art consisting of circular heads or discs which are arranged axially side by side. Member 12 is affixed to a driving shaft 18 which forms a part of previously identified driving means B. As seen in FIG. 1, shaft 18 is rotatably carried by bearing assemblies 20 and 22 mounted on frame member 24 which comprises a part of the main frame 25 of the apparatus. Connected to shaft 18 is a driven sheave 23 adapted to be driven through drive belts 26 by a driving sheave 28 connected to a motor means 30. Member 14 is non-rotatable but, in a manner presently to be discussed, is capable of axial adjustment relative to member 12.

Figure 4:
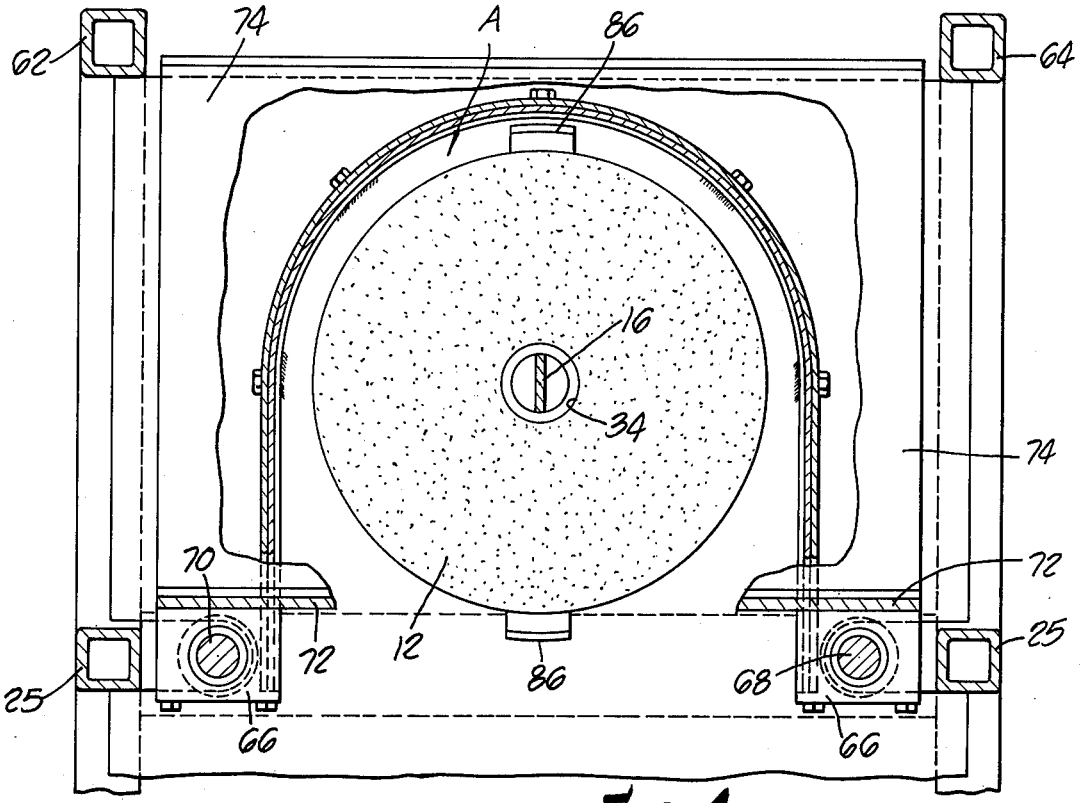
FIG. 4 is a view taken along lines 4—4 of FIG. 2.

Turning again to FIG. 2 and referring also to FIG. 4, the material grinding chamber A is provided with an opening 32 for receiving material to be ground, which opening communicates with axial passageways 34 and 36 formed in grinding members 12 and 14 respectively. When the grinding members are in grinding proximity as shown in FIG. 2, first feed worm 16 which is attached to solid shaft 18 (FIG. 2) and rotates therewith extends axially through passageways 34 and 36 with its free or left end 16*a* protruding into a feed nozzle 38 which comprises part of the force feed means of the invention. The right or forward end of feed worm 16 is connected to and rotatably driven by shaft 18.

The force feed means of the form of the invention shown in the drawings comprises a material dispensing hopper 40 and a second generally helically shaped feed worm 42 disposed in axial alignment with first feed worm 16. Second feed worm 42 is rotatably driven about its longitudinal axis by a motor means 44 through a drive train 46 of a type well known in the art.

As best seen in FIG. 1, feed worm 42 extends through feed hopper 40 and through a forwardly extending tubular housing 48. Bearing assemblies 50 (FIG. 2) and 52 rotatably support the feed worm at its forward and rearward ends. Feed worm 42 is so constructed and arranged as to carry the material to be ground from the hopper forwardly of the apparatus into tubular housing 48 which is connected to the lower side portion of hopper 40 and extends forwardly thereof.

Disposed intermediate tubular housing 48 and grinding member 14 is the previously identified frustoconically shaped nozzle 38. As shown in FIG. 2, the major diameter opening 54 of nozzle 38 is in communication with the forward extremity of housing 48 while the minor diameter opening 56 thereof is in communication with opening 32 of the material grinding chamber. It is to be observed that with the material grinding members 12 and 14 in grinding proximity, first feed worm 16 is telescopically received into nozzle 38 through minor diameter opening 56.

Figure 3:
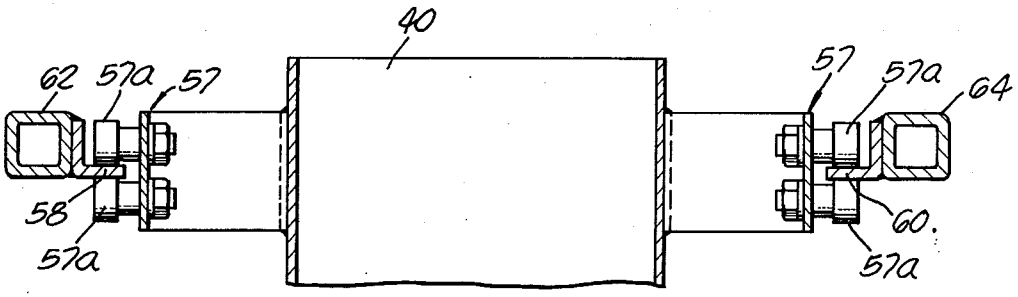
FIG. 3 is a view taken along lines 3—3 of FIG. 2.

Referring to FIGS. 1, 2 and 3, it will be observed that the entire force feed means, as well as grinding member 14 which is attached thereto, is mounted on a carriage means which is reciprocally movable axially of the apparatus from the position shown in FIG. 1 to the position shown in FIG. 2. As best seen in FIGS. 1 and 3, the carriage means of this form of the invention comprises roller assemblies 57 mounted near the upper side portions of hopper 40. The opposed roller members 57*a* of the roller assemblies are adapted to roll along horizontally extending track members 58 and 60 (FIG. 3) which are affixed as by welding to horizontally extending frame members 62 and 64, which members form a part of main frame 25.

Figure 5:
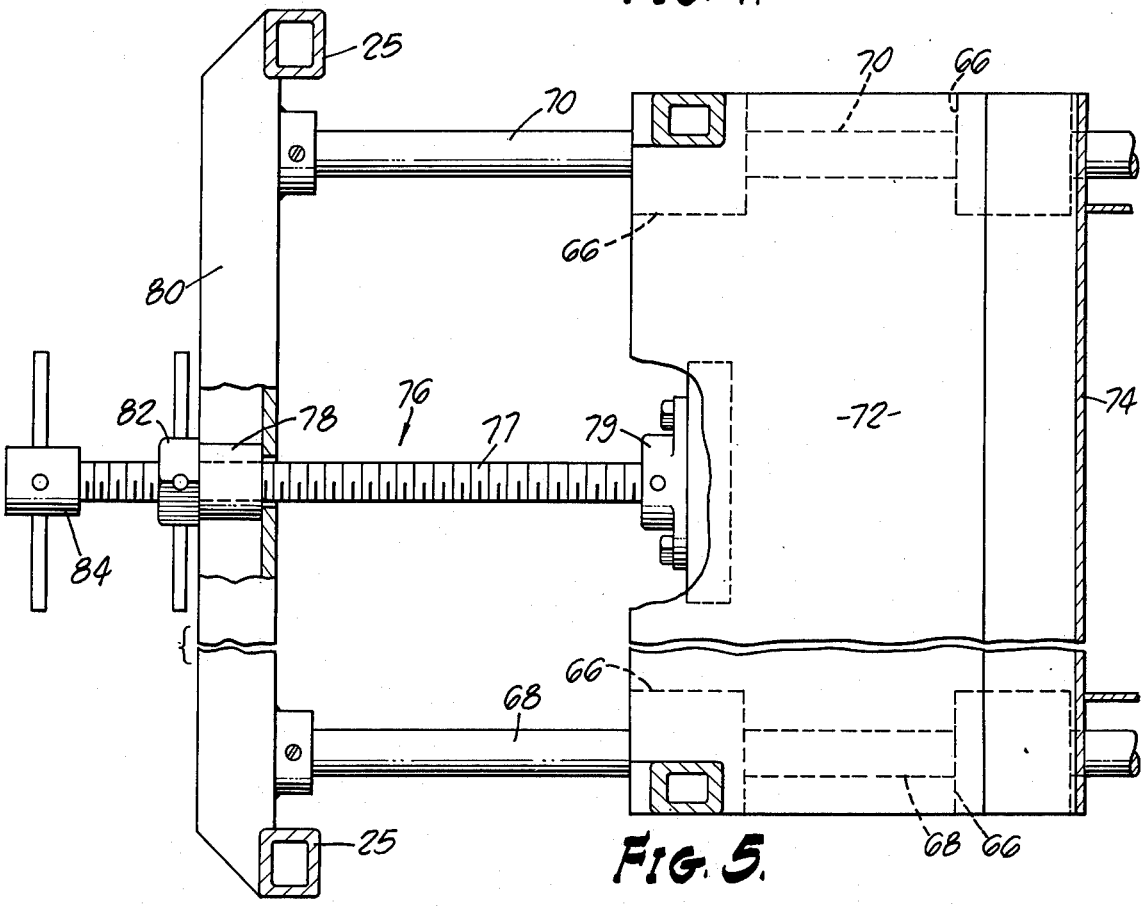
FIG. 5 is a view taken along lines 5—5 of FIG. 2.

As shown in FIGS. 1, 4 and 5, the forward portion of the force feed means includes bushings 66 adapted to slide along horizontally extending guide rods 68 and 70 carried by main frame 25.

As best seen in FIG. 2, bushings 66 are affixed to the lower surfaces of a horizontally extending carriage plate 72 which also forms a part of the carriage means of this embodiment of the invention. Carriage plate 72 is, in turn, affixed to a generally vertically extending supporting plate 74 to which both grinding member 14 and nozzle 38 are connected.

To move the carriage means and the force feed means which it supports forwardly of the apparatus from the position shown in FIG. 1, there is provided a screw means generally indicated by the numeral 76. Screw means or assembly 76 comprises an elongated, horizontally extending threaded screw 77 adapted to threadably engage a nut assembly 78 (FIG. 5) carried by a transverse frame member 80 forming a part of main frame 25. The forward end of screw 77 is received in a collar assembly 79 affixed to carriage plate 72 so that upon rotation of the screw relative to the fixed nut assembly 78, the force feed means will be moved axially of the apparatus. To control the extent of forward movement of the carriage and force feed means, there is provided a lock nut assembly 82 which is located rearwardly of nut assembly 78 and is threadably movable axially along threaded screw 77. A handle assembly 84 is provided at the rearward extremity of threaded screw 77 to assist in rotating the screw so as to move the force feed means axially of the apparatus.

OPERATION

In operation, the grinding members are first moved into grinding proximity as shown in FIG. 2 by rotating threaded screw 77 to move the carriage means forwardly or to the right of the apparatus as it is viewed in FIG. 1. Depending upon the fineness to which the material is to be ground, the grinding members can be moved into close proximity or they can be positioned so that their grinding faces are slightly spaced apart.

With the grinding members in proper grinding proximity and with the hopper 40 filled with the material to be ground, motors 30 and 44 are activated. This causes rotation of the first and second feed worms 16 and 42 of grinding member 12. As feed worm 42 rotates, the material within the hopper will be carried forwardly of the apparatus and will be forced at a constant rate into the major diameter opening in frustoconically shaped nozzle 38. The forwardly tapering walls of the nozzle will, in effect, force feed the material to the first feed worm 16 which, in turn, will carry it onto the grinding chamber and to the grinding members. The grinding members receive the material to be ground between their grinding faces at points adjacent the axis of rotation so that the material is passed radially outwardly between the members, is ground, and escapes at the periphery of the members where it falls by force of gravity from the grinding chamber A. As best seen in FIGS. 2 and 4, scraper blades 86 are provided adjacent the periphery of the grinding members to assist in dispensing the ground material from the apparatus and to prevent buildup thereof within the grinding chamber A. Because of the unique force feeding feature of the apparatus of the invention, a controllably uniform rate of output of ground material from the apparatus is realized.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A material grinding apparatus for continuously grinding corn and the like in a manner to provide an output of ground material at a uniform controllable rate, comprising:

a. a material grinding chamber having an opening for receiving material to be ground;

b. first and second cooperating material grinding members in said chamber, said first grinding memeber being rotatable and said second grinding member being nonrotatable;

c. a first feed worm disposed in axial alignment with the opening in said grinding chamber for feeding the material to be ground to said grinding members;

d. a force feed means cooperatively associated with said first feed worm for controllably feeding the material to be ground to said first feed worm at a predetermined rate, said force feed means comprising:

1. a material dispensing hopper;

2. a second feed worm disposed in axial alignment with said first feed worm and cooperatively associated therewith for receiving the material from said hopper and feeding it to said first feed worm; and 3. a frustoconically shaped nozzle disposed intermediate said second feed worm and said material grinding chamber, said nozzle having a rearward opening and a smaller diameter forward opening adapted to telescopically receive at least a portion of said first feed worm; and e. a carriage means reciprocably movable toward and away from said first grinding member for carrying said second nonrotatable material grinding member and said force feed means whereby said second grinding member can be moved into and out of material grinding engagement with said first grinding member.

2. A material grinding apparatus comprising:

a. a material grinding chamber having an opening for receiving material to be ground;

b. first and second cooperating material grinding members in said chamber, one of said members being rotatable relative to the other;

c. a continuously driven shaft carrying said first grinding member for rotatably driving said member; and d. a first feed worm disposed in axial alignment with the opening in said grinding chamber for feeding the material to be ground to said grinding members;

e. a force feed means cooperatively associated with said first feed worm for controllably feeding the material to be ground to said first feed worm at a predetermined rate, said force feed means comprising:

1. a material dispensing hopper;

2. a second feed worm disposed in axial alignment with said first feed worm and cooperatively associated therewith for receiving the material from said hopper and feeding it to said first feed worm; and f. a carriage means reciprocably movable toward and away from said first grinding member for carrying said second material grinding member, said second member being nonrotating, and said force feed means whereby said second grinding member can be moved into and out of material grinding engagement with said first grinding member.

3. A material grinding apparatus as defined in claim 2 including screw means for controllably moving said carriage means relative to said first grinding member.

4. A grinding apparatus for grinding corn and the like comprising:

a. a supporting frame;

b. a continuously driven shaft rotatably supported by said frame;

c. a first disc-shaped grinding member affixed to said shaft proximate one end thereof, said grinding member having an axially extending opening therethrough;

d. a second nonrotatable disc-shaped grinding member disposed in axial alignment with said first grinding member, said member having an axially extending opening therethrough;

e. a first feed worm affixed to said shaft and normally extending through the openings in said first and second grinding members;

f. a force feed means carried by said frame for feeding material to be ground to said first feed worm at a constant rate, said means comprising:

1. a continuously rotatable second feed worm disposed in axial alignment with said first feed worm;

2. a material dispensing hopper for dispensing material to said second feed worm; and 3. a feeding nozzle disposed intermediate said second grinding member and said second feed worm, said feeding nozzle having a rearward opening in communication with said second feed worm and a smaller diameter forward opening in communication with said first feed worm; and g. a carriage adapted to carry said second grinding member and said force feed means, said carriage being mounted on said frame for reciprocal movement toward and away from said first grinding member.

* * * * *